United States Patent [19]

Nyborg, Jr.

[11] 4,228,873

[45] Oct. 21, 1980

[54] ELEVATOR DOOR SAFETY MECHANISM

[75] Inventor: George L. Nyborg, Jr., Bronxville, N.Y.

[73] Assignee: Tri-County Elevator Co., Inc., Bronxville, N.Y.

[21] Appl. No.: 956,848

[22] Filed: Nov. 2, 1978

[51] Int. Cl.[3] ..... B66B 13/00

[52] U.S. Cl. ..... 187/61; 70/91

[58] Field of Search ..... 187/61, 57, 59; 70/91, 70/371, 449, 101, 102, 156, 151, 90, 141, 475, 477

[56] References Cited

U.S. PATENT DOCUMENTS

| | | | |
|---|---|---|---|
| 1,887,016 | 12/1932 | Hagstrom et al. | 70/101 |
| 2,098,189 | 11/1937 | Kistner | 70/90 |
| 2,313,172 | 3/1943 | Rechberger | 187/61 |
| 3,298,210 | 1/1967 | Nyborg | 70/91 |
| 3,973,420 | 8/1976 | Brady et al. | 70/101 |

*Primary Examiner*—David A. Scherbel
*Assistant Examiner*—Kenneth Noland
*Attorney, Agent, or Firm*—Hopgood, Calimafde, Kalil, Blaustein & Lieberman

[57] ABSTRACT

An elevator shaft door safety mechanism which permits the shaft door to be opened by authorized persons when the elevator is not in place. The mechanism is particularly suitable for use with doors of the hingedly mounted type. The mechanism is lock controlled and permits manual operation of the latching mechanism with the use of a special tool.

7 Claims, 8 Drawing Figures

ELEVATOR DOOR SAFETY MECHANISM

BACKGROUND AND SUMMARY OF THE INVENTION

This invention relates generally to elevator shaft doors of the hingedly mounted type, and in particular to a safety mechanism therefor that permits the shaft door to be opened when the elevator car is not in place, yet prevents unauthorized opening of the door.

My U.S. Pat. No. 3,298,210, is directed to an elevator shaft door safety mechanism which is particularly suitable for use with shaft doors of the sliding type. The present invention is particularly suitable for use with shaft doors of the hingedly mounted, or swinging type. The invention provides a means for permitting the elevator shaft door to be opened even though the elevator car is not in place. The need to open the shaft door, even though the car is not in place may arise in emergency or maintenance orientated circumstances. The mechanism which permits the door to be opened, is secure and lock controlled so that unauthorized persons may not open the door without the car in place.

The invention discloses a removable lock cylinder mounted to the shaft door which permits access to a manually operable mechanism mounted on the latch mechanism to permit the door to be opened. The latch mechanism is usually operated by the presence by the elevator car itself.

Accordingly, it is an object of this invention to provide an elevator shaft door safety mechanism particularly suitable for use on hinged shaft doors.

Another object of this invention is to provide an improved safety mechanism which permits an elevator shaft door to be opened even though the elevator car is not present.

Another object of this invention is to provide an elevator shaft or safety mechanism which is secure against unauthorized opening.

Yet another object of this invention is to provide an improved elevator shaft door mechanism which is simple and economical to install, operate and maintain.

Still other objects of this invention will become apparent upon a reading of the detailed specification to follow.

BRIEF DESCRIPTION OF THE DRAWING

For better understanding of the invention, reference is made to the following drawings, taken in connection with the Specification in which.

DESCRIPTION OF THE PREFERRED EMBODIMENTS

Figure 1:
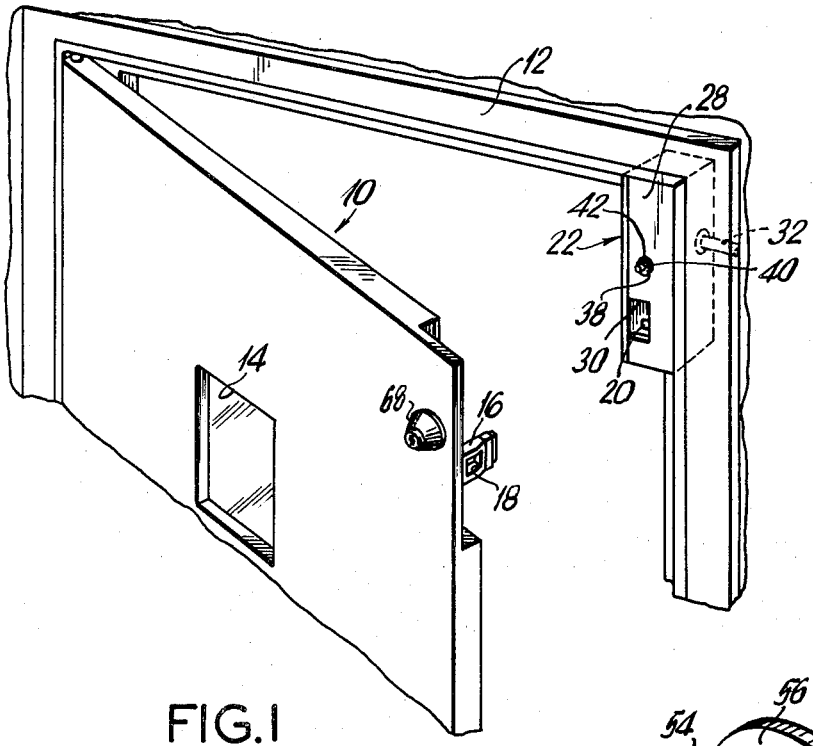
FIG. 1 is a perspective view of the elevator shaft door safety mechanism constructed in accordance with the instant invention with the elevator shaft door shown in an open position.
Figure 2:
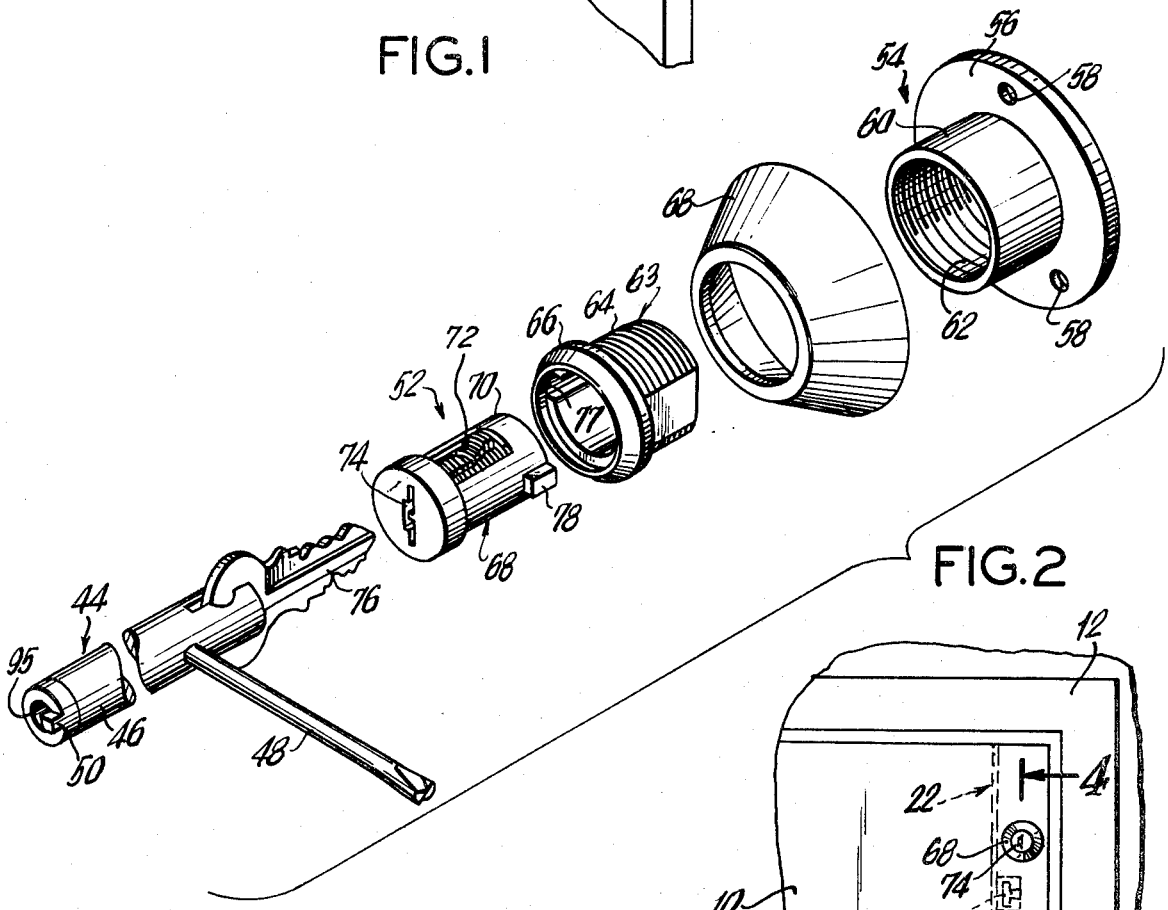
FIG. 2 is an exploded view of the components of the arrangement for manually opening the shaft door.
Figure 3:
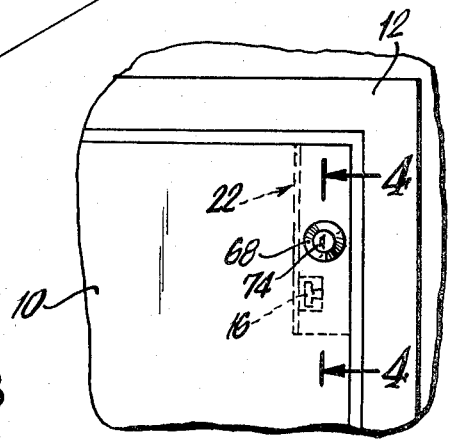
FIG. 3 is an elevational view of a corner of the shaft door in a closed position.
Figure 4:
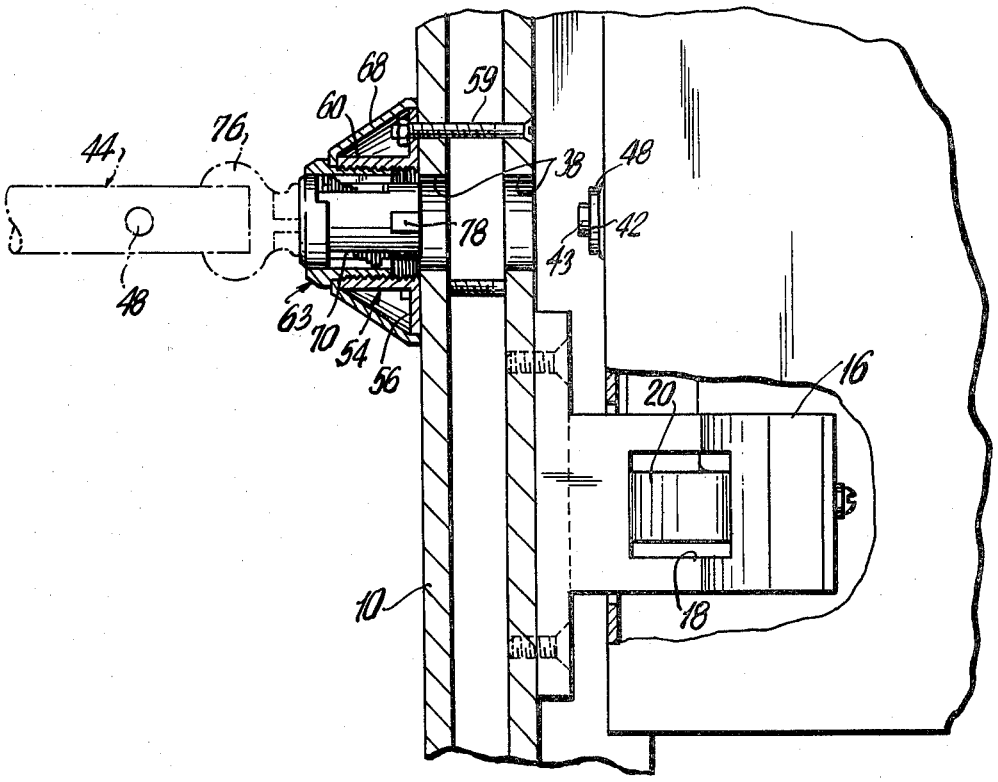
FIG. 4 is a sectional view taken along line 4—4 of FIG. 3.
Figure 5:
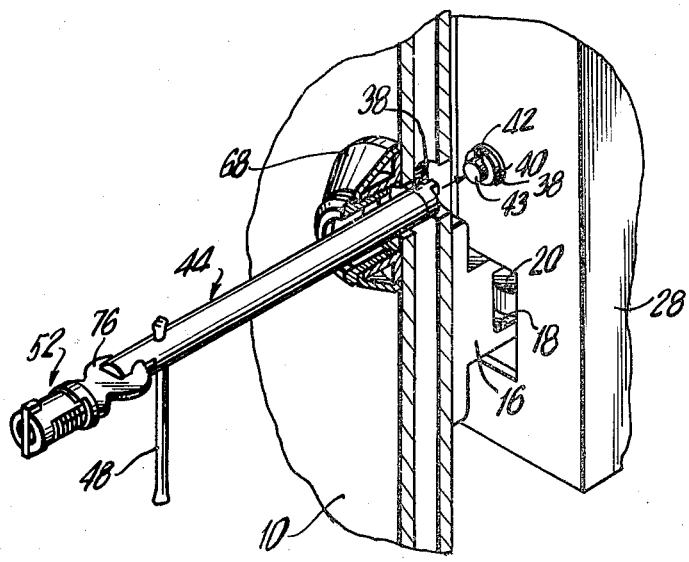
FIG. 5 is a sectional view in perspective of the operation of manually opening the shaft door.

The drawings illustrate the elevator shaft door safety mechanism of the instant invention. An elevator shaft door 10 is hingedly mounted to a door frame 12 and pivots open and closed. Shaft door 10 includes a window 14 to permit a person to see if the elevator car (not shown) is present. Fixed to the side of shaft door 10 facing the shaft is a keeper member 16 which has an opening 18 which will be engaged with a bolt 20 of a latching mechanism 22. The upper outside corner 24 of shaft door 10 includes a recess 26 so that it may clear latching mechanism 22.

Latching mechanism 22 is contained within a box 28 mounted to door frame 12 at a corner thereof. The portion of box 28 facing door 10 includes an opening 30 to receive keeper member 16. Latching mechanism 22 includes a rod 32 mechanically connected, by known means, to bolt 20 to permit it to be moved into and out of engagement with opening 18 of keeper member 16. Rod 32 is in turn connected to an arm and a roller (not shown). The roller is mounted and arranged so that when an elevator car is present, it will be contacted by the car door operating mechanism of the elevator car. Upon contact of the roller by the car door mechanism, the arm and rod 32 will be pivoted so as to disengage bolt 20 from opening 18 of keeper member 16 to permit shaft door 10 to be manually opened. When the elevator car is not in place behind door 10, there will be no contact with the roller and accordingly, bolt 20 will be in engagement with lock keeper member 16 to latch shaft door 10 closed.

The above described mechanism unlatches latching mechanism 22 when the elevator car is in place behind shaft door 10. In emergency situations, or for maintenance purposes, it is desirable to be able to open shaft door 10 even if the elevator car is not in place. The mechanism for accomplishing this purpose will now be described. Disposed above opening 30 on latch mechanism 22 is a second opening 38 to permit access to a rod 40 which is circular in cross section and has a notch 42 about its outer periphery. Rod 40 includes a cylindrical portion 43 extending forwardly therefrom. Rod 40 is mechanically linked to bolt 20 so that when rod 42 is rotated about its longitudinal axis, bolt 20 will be withdrawn from opening 18 of keeper member 16 to permit shaft door 10 to be opened. In order to turn rod 40, a latch lever 44 is used, which consists of a cylindrical portion 46 having a cross-bar 48 at one end and a tab 50 engageable with notch 42 of rod 40. Latch lever 44 includes a cylindrical recess 45 for engagement with portion 43 of Rod 40 to keep both in alignment.

When shaft door 10 is in its closed position, it will prevent access to rod 40. In order to gain access to rod 40, a removable cylinder lock 52 is mounted to shaft door 10 in a location proximate to the position of rod 42. Cylinder lock 52 consists of a threaded mounting base 54 which includes a flange 56 mounted to the interior of shaft door 10 by means of suitable fasteners such as screws 59, extending through openings 58. Mounting base 54 also includes a cylindrical portion 60 of a length equal to that of the width of shaft door 10, and which includes a threaded interior portion 62. Threads 62 engage a plug receiver 63 which has external threads 64 to engage internal threads 62 and a collar 66. Disposed between plug receiver 64, and mounting base 60 is a collar cover 68 in the shape of a truncated cone and which will fit between collar 66 and the outside of the door 10.

Inserted into plug receiver 64 is a plug 68 having a body portion 70 from which lock bolts 72 extend laterally, and an opening 74 for a key 76. A tab 78 also extends from body portion 70 to engage a groove 79 in plug receiver 64 to prevent body portion 70 from rotating in plug receiver 64. When key 76 is inserted into slot 74, of plug 68, lock bolts 72 will withdraw within body portion 70 to permit plug 68 to be removed. When plug 68 is removed, access is had to opening 38 of latching mechanism 22 to enable lever 44 to be inserted and in turn to open door 10, even though no elevator car is present. After the opening is completed, plug 68 is reinserted into receiver 64 and ksy 76 removed to block access to the latch mechanism. Key 76 has been shown as attached to the other end of lever 44 for compactness, of course it may also be separate therefrom.

Figure 6:
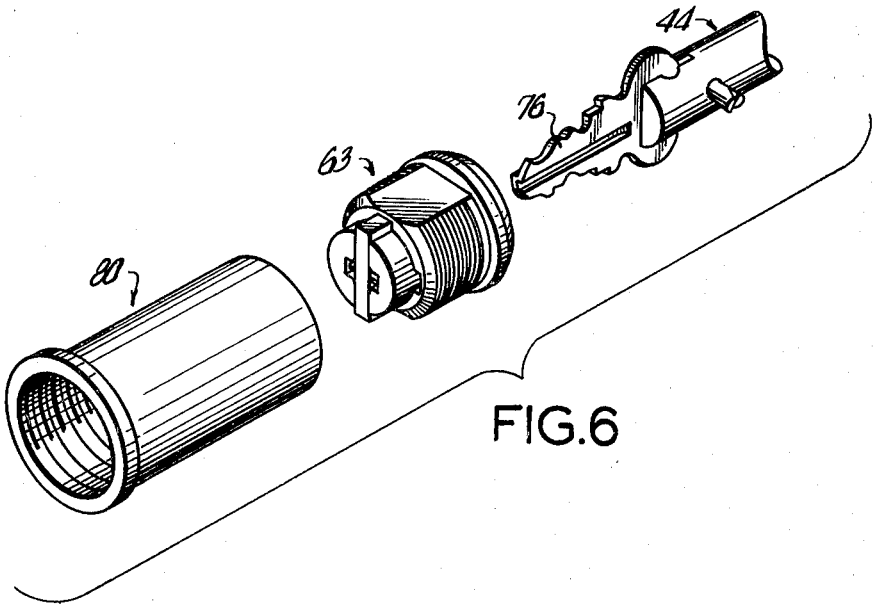
FIG. 6 is an exploded view of another preferred embodiment of the lock cylinder mounting arrangement.
Figure 7:
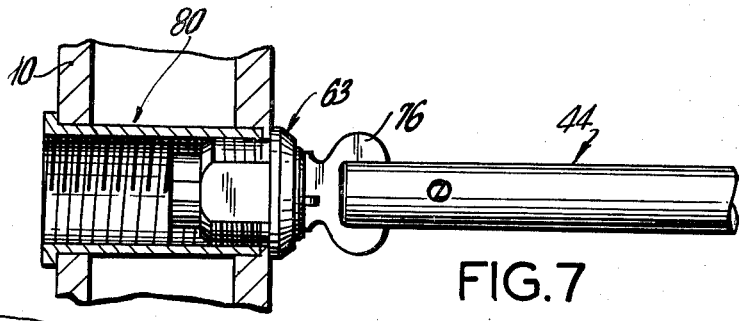
FIG. 7 is a sectional view of the mounting arrangement of FIG. 6 shown attached to an elevator shaft door.

FIGS. 6 and 7 illustrate another preferred mounting assembly for lock unit 52 which uses a longer threaded base 80 into which plug receiver 63 is threaded. No collar cover is used and the threaded engagement of base 80 and plug 63 mounts the assembly to the door.

Figure 8:
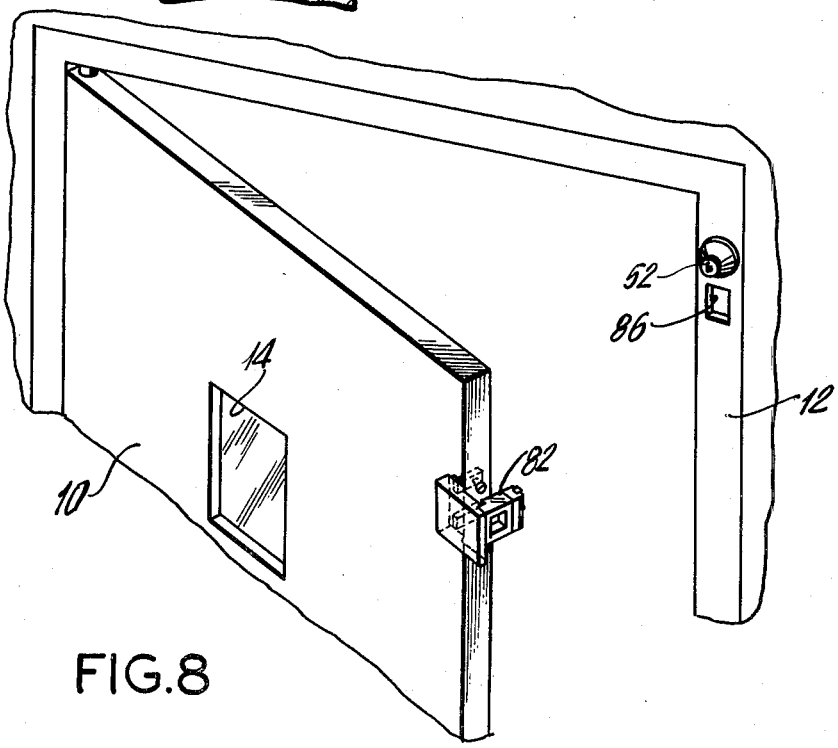
FIG. 8 is a perspective view of another preferred embodiment of the safety door mechanism of the present invention.

FIG. 8 illustrates the safety mechanism mounted on door 10 having an off-set keeper member 82 which mounts the keeper away from the edge of the door 10. In this arrangement, cylinder lock 52 is mounted to the door frame 12 rather than the door 10 itself. An opening 86 in frame 12 permits access to the bolt of the latching mechanism, in all other respects the units are identical and the removal of cylinder lock 52 will provide access to the latching mechanism.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. A safety mechanism for an elevator shaft door which is hingedly mounted to a door frame, comprising in combination:

latching means to latch said door to said door frame, said latching means including bolt means, keeper means mounted on said door for engagement with said bolt means of said latching means, said latching means including first and second latch releasing means to free said keeper means from said engagement to said bolt means to permit said door to open, said first latch releasing means being operated by the presence of an elevator proximate to said door, said second latch releasing means including a rod mounted therein, said rod being in engagement with said bolt means, said rod being manually operable to release said engagement of said keeper means by said bolt means, an aperture in at least one of said door and said door frame to permit access to said second latch releasing means; and lock means releaseably engageable with said aperture to seal said aperture when said lock means are in place and to permit access to said aperture when said lock means are removed.

2. The mechanism as claimed in claim 1, wherein said aperture and said lock means are disposed on said door.

3. The mechanism as claimed in claim 1, wherein said aperture and lock means are disposed on said door frame.

4. The mechanism as claimed in claim 1, wherein said lock means include a plug receiver, a removeable plug releaseably engageable with said plug receiver and key means insertable into said plug to release said plug from said plug receiver.

5. The mechanism as claimed in claim 4, wherein said plug includes at least one lock bolt, said lock bolt extending laterally from said plug to engage said plug receiver when said key means are not inserted in said plug.

6. The mechanism as claimed in claim 4, wherein at least one of said plug and said plug receiver includes a tab, and the other of said plug and said plug receiver includes a groove, said tab being insertable within said groove to prevent said plug and said plug receiver from rotating with respect to each other.

7. The mechanism as claimed in claim 1, wherein said first latch releasing means comprise means for engagement with the door of an elevator car, when said car is in proximity to said shaft door.

* * * * *